United States Patent [19]

Austin

[11] 4,197,985

[45] Apr. 15, 1980

[54] TAMPERPROOF DISPENSING CARTON AND BLANK THEREFORE

[75] Inventor: John J. Austin, Hinsdale, Ill.

[73] Assignee: Champion International Corporation, Stamford, Conn.

[21] Appl. No.: 16,812

[22] Filed: Mar. 2, 1979

[51] Int. Cl.[2] ..... B65D 5/76; B65D 5/00

[52] U.S. Cl. ..... 229/17 SC; 229/7 SC; 222/561; 222/456

[58] Field of Search ..... 229/17 SC, 7 SC; 222/561, 456

[56] References Cited

U.S. PATENT DOCUMENTS

| | | | |
|---|---|---|---|
| 2,342,081 | 2/1944 | Kirkland et al. | 229/17 SC |
| 2,931,553 | 4/1960 | Tamarin | 229/17 SC |
| 4,066,207 | 1/1978 | Jorgensen-Beck | 229/17 SC |
| 4,094,456 | 6/1978 | Roccaforte | 229/17 SC |
| 4,138,016 | 2/1979 | Roccaforte | 229/17 SC |
| 4,138,041 | 2/1979 | Capo et al. | 222/456 |
| 4,141,485 | 2/1979 | Lambert | 229/17 SC |

*Primary Examiner*—Davis T. Moorhead
*Attorney, Agent, or Firm*—Evelyn M. Sommer

[57] ABSTRACT

A dispensing carton made from a single blank which is capable of being formed, filled and sealed on automatic equipment. The dispensing carton is made tamperproof by providing for a cover tab, which must be removed from the carton before a slidable closure section can be displaced to open the carton. The removal of the cover tab permanently alters the appearance of the carton which acts as a deterrent to tampering. The dispensing carton further provides a slidable closure section ruptu-rably connected to the carton, which requires no hinge connection to the carton after its initial use. The slidable closure section is further provided with a locking flange which cooperates with a cut line in the carton to control the longitudinal displacement of the closure section.

16 Claims, 4 Drawing Figures

TAMPERPROOF DISPENSING CARTON AND BLANK THEREFORE

The subject invention relates to a new and improved tamperproof reclosable dispensing carton and a blank for forming said dispensing carton which is capable of being formed, filled and sealed on automatic equipment.

Prior art dispensing cartons include reclosable dispensing cartons which have hinged closure sections. Such a prior art carton, while on display, may be readily opened, permitting removal of its contents, after which it can be reclosed with no resultant change to its external appearance. Further, the closure sections found in the prior art cartons are generally hingedly attached to some part of the carton, such that repeated use of the closure section could weaken the hinge connection, possibly causing breakage.

Accordingly, it is an object of the subject invention to provide a carton which is tamperproof in that if the carton is opened, its appearance will be substantially altered so that a consumer can readily detect the tampering.

It is a further object of the subject invention to obviate a shortcoming of the prior art, by providing an unhinged slidable closure section which cannot wear out from repeated use.

It is still a further object of the subject invention to provide a new and improved means by which both the amount of displacement and return positioning of the closure section can be accurately controlled.

It is still a further object of the subject invention to provide a carton which can be slipped to the packager in a flat configuration and then be erected on automatic machinery.

The subject invention relates to a dispensing carton wherein one upper side of the carton includes an overlapping arrangement of sections, with an outer panel and one side of the carton having registered openings therein, while an intermediate closure section is slidably mounted between said side of the carton and the outer panel. The slidable closure section is operative to uncover said registered openings to enable the dispensing of the contents within the carton, after which the closure section may be slidably moved to a position so as to cover the registered openings for reclosing the carton. The outer section includes a rupturably connected cover tab, displaced along one edge and over the closure section, which tab must be removed before the closure section may be displaced. Upon removal, the rupturable connection is severed such that the cover tab cannot be replaced, thus affording clear, visible evidence of the use of the carton. This arrangement acts as a deterrent, and will lessen the likelihood of tampering with the carton.

The displacement of the closure section should be accurately controlled. This objective is achieved by means of a locking flange located on the slidable closure section which is slidably engaged along a locking cut line adjacent the top of the carton. The lengths of the locking cut line and the locking flange control the amount of displacement of the slidable closure section. When the closure section is slidably displaced to its open position, the locking flange is stopped at the termination of the locking cut line thereby preventing the closure section from being further displaced. Similarly, when the closure section is returned to its initial position, the opposed terminus of the locking cut line acts as a stop against the locking flange to prevent the slidable closure section from being displaced beyond its initial position.

To operate the closure section, the rupturable connections must be broken. Until that time, however, the closure section securely covers the registered apertures in the carton thereby insuring the protection of the contents of the carton during shipment and display.

Further objects and advantages of the subject invention will become apparent from the following detailed description taken in conjunction with the drawings, in which.

Figure 1:
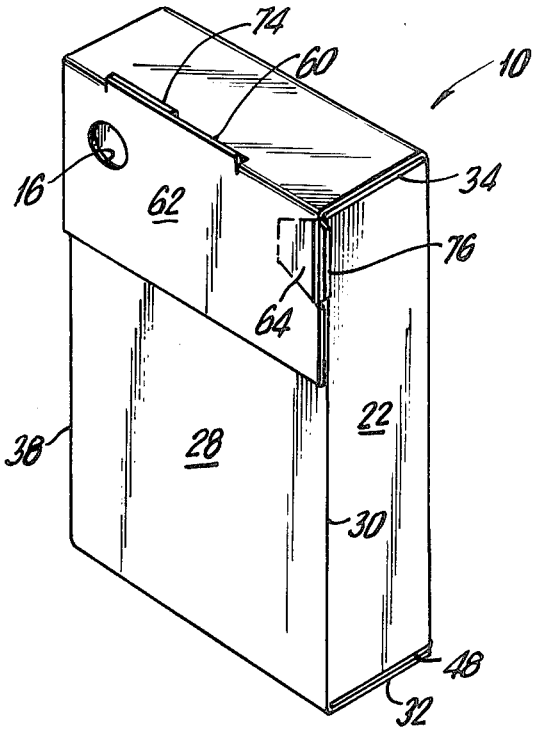
FIG. 1 is a perspective view of the dispensing carton of the subject invention.

Referring to FIG. 1, the dispensing carton of the subject invention is designated generally by the numeral 10 and is intended to store and conveniently dispense pills or granular products. The dispensing carton is of elongated tubular design having a generally rectangular cross section. The carton includes a dispensing means that may be opened for dispensing the contents and reclosed for storage purposes.

Figure 2:
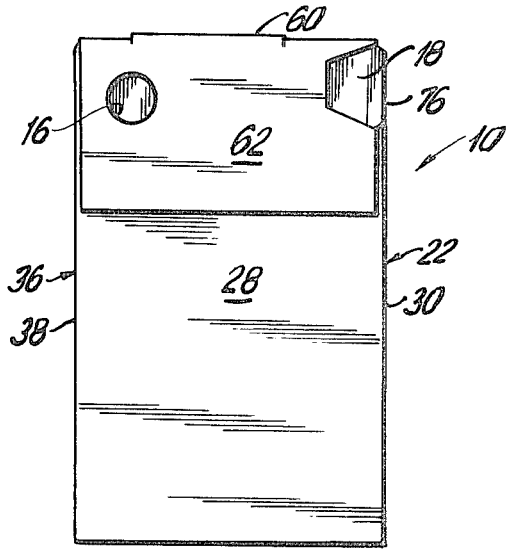
FIG. 2 is a side elevational view of the dispensing carton in its initial closed condition.
Figure 3:
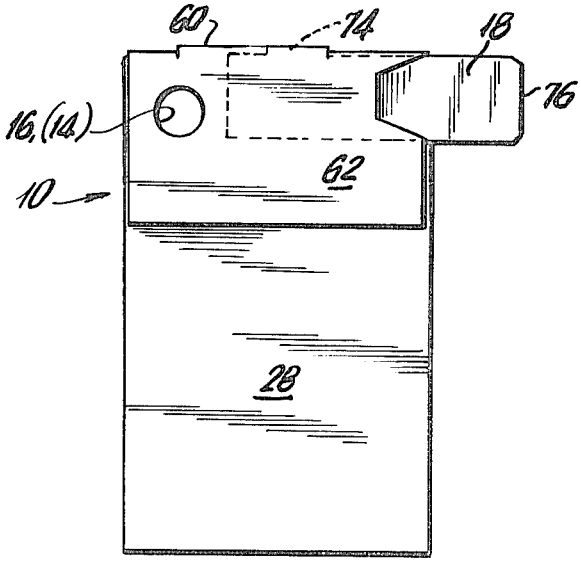
FIG. 3 is a view similar to FIG. 2 but with the cover section in its displaced position to enable dispensing of the contents of the carton.

Dispensing carton 10, erected from a foldable blank 20 (see FIG. 4) is preferably made of a foldable paperboard or similar sheetlike material which is intended to be formed, filled and sealed on automatic equipment. In its fully erected condition the carton blank is closed at both ends, with registered apertures 14 and 16 being covered by a slidably mounted closure section 18. When the closure section is in a displaced position (see FIG. 3), the registered apertures 14 and 16 are uncovered to enable the contents within the carton to be dispensed. As illustrated in FIG. 2, when the closure section 18 is replaced to its initial position, the apertures 14 and 16 are closed.

Figure 4:
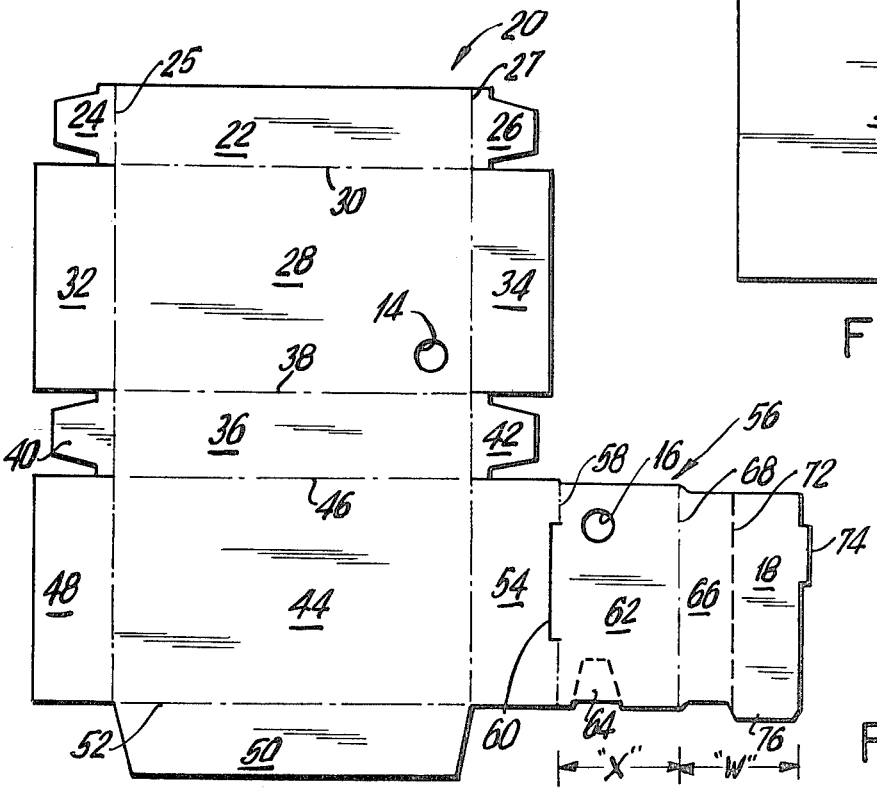
FIG. 4 is a plan view of the blank of the subject invention.

As illustrated in FIG. 4, the carton blank 20 for forming the carton of the subject invention includes a first edge panel 22 having a first bottom tab 24 and a first top tab 26 hingedly connected along fold lines 25 and 27. A first side panel 28 is hingedly connected along fold line 30 to the first edge panel 22. The first side panel 28 includes an aperture 14 whose diameter is slightly larger than the diameter of the items to be dispensed from the carton. The aperture 14 is disposed in an upper corner of the panel such that when the carton is erected the aperture will be in register with the dispensing aperture 16 as more fully described hereinafter. An outer bottom panel 32 and an inner top panel 34 are hingedly attached along fold lines 25 and 27 on the opposed edges of the first side panel 28. A second edge panel 36 is hingedly attached along fold line 38 to the first side panel 28, with a second bottom tab 40 and a second top tab 42 being hingedly connected along fold lines 25 and 27 to the opposed edges of the second edge panel 36. A second side panel 44 is hingedly connected along fold line 46 to the second panel 36. An inner bottom panel 48 is hingedly attached along fold line 25 to one edge of the second side panel 44. An inner edge panel 50 is hingedly attached along fold line 52 to the second side panel 44.

A dispensing panel indicated generally by numeral 56 is hingedly connected along fold line 27 to the second side panel 44. An outer top section 54 disposed adjacent to the second side panel 15 is one of four sections forming the dispensing panel. An apertured section 62 is hingedly connected along fold line 58 to the outer top section 54. The fold line 58 includes a spaced cut, offset towards the outer top panel 54 which defines the locking cut line 60. The length of this offset cut controls the amount of displacement of the slidable closure section as more fully described hereinafter. The apertured section 62 has an aperture 16 which substantially corresponds to the configuration of the aperture 14 in the first side panel 28, and is disposed such that when the carton is erected the aperture 16 will be in register with the aperture 14 of the first side panel 28. The apertured section 62 further includes a cover tab 64 which is disposed on the edge of the tab opposed to the aperture 16. The cover tab 64 has a generally semi-circular configuration, and is rupturably connected to the apertured section 62. A middle section 66 is hingedly connected along fold line 68 to the apertured section 62. A closure section 18 is rupturably connected to the middle section 66 along perforation 72. The closure section 18 includes a locking flange 74 along the edge of the closure section 18 which is opposed to the perforation 72. The closure section 18 further includes an arcuate flange 76 disposed along the same edge of the dispensing tab 56 as the cover tab 64. The arcuate flange 76 aids in the manual gripping of the slidable closure section 18. The total width "W" of both the middle and closure sections 66 and 18, respectively, substantially corresponds to the width "X" of the apertured section 62.

In the erection of the dispensing carton 10, the elongated tubular closed carton is formed by bending the first and second side panels 28 and 44 along fold lines 38 and 46 such that they lie in parallel planes separated by the second edge panel 36. Then the inner edge panel 50 is bent along fold line 52 to meet the first side panel 28. The first edge panel 22 is then bent along fold line 30 to meet the second side panel 44. The first edge panel 22 overlaps the inner edge panel 50 and the panels are adhesively joined. The top and bottom tabs 26, 42, 24 and 40 are then bent along fold lines 25 and 27 respectively towards the inside of the carton. The bottom portion of the carton is sealed when the inner bottom panel 48 is bent along fold line 25 to meet the first side panel 28. The outer bottom panel 32 is then bent along fold line 25, such that it overlaps the inner bottom panel 48 and is adhesively attached thereto. The top portion of the carton is closed in a similar manner. The inner top panel 34 is bent along fold line 27 to meet the second side panel 44. The outer top section 54 is bent along fold line 27, such that it overlaps the inner top panel 34, but is left unglued to prevent excess adhesive from interfering with the proper functioning of the closure section.

The structure for the dispensing means is formed by bending the middle and closure sections 66 and 18 along fold line 68 to an abutting relation with the apertured section 62. The middle and closure sections 68 and 70 are bent in a direction such that when the apertured section 62 is bent along fold line 58 a layered arrangement results with the apertured section 62 on top, the middle closure section 66 and 18 forming an intermediate layer and the first side panel 28 forming the bottom layer. The middle section 66 is adhesively joined to both the first side panel 28 and the apertured section 62. In the erected carton, the apertures 14 and 16 are in register, with the closure section 18 located between the apertures such that the carton is closed. Also, the locking flange 74 of the closure section 76 is engaged in the locking cut line 60.

To open the carton and dispense the contents, the cover tab 64 must first be torn away exposing the edge of the closure section 18 underneath (see FIG. 2). Since the cover tab must be removed before the carton can be opened, and cannot be replaced, tampering with the carton while on display is deterred because the carton cannot be restored to its original condition. After removal of the cover tab 64, the closure section 18 can then be displaced manually, facilitated by the arcuate flange 76 which is useful in gripping the closure section 18. Then, closure section 18 is pulled, rupturing the perforation 72 between the closure section and the middle section 66. Until perforation line 72 to the closure section 18 is broken, such as during shipment and display of the carton, the contents inside the carton are safely sealed inside the carton. When the closure section 18 is displaced, the registered apertures 14 and 16 are uncovered and the contents of the carton may be dispensed. To close the carton, the closure section 18 is slidably replaced to its initial position thus covering the apertures. The closure section 18, since it is unhinged, will not wear out with repeated use.

The amount of displacement of the closure section 18 and the location to which it can be replaced is controlled by the length and positioning of the locking cut line 60 and the locking flange 74. When the closure section 18 is displaced, the locking flange 74 projects through and slides within the locking cut line 60 until it reaches the termination of the cut line, thus halting the closure section 18, preventing it from being removed from the carton. When the carton is reclosed, the locking flange 74 is stopped at the opposed terminus of the locking cut line 60 thereby limiting the movement of the closure section 18 as it is returned to its initial position.

Accordingly, there is provided a new and improved dispensing carton and blank for forming the same, for pills and granular substances which can be formed, filled and sealed on automatic equipment. The dispensing carton of the subject invention is made tamperproof by providing for cover tab 64 which must be removed before the slidable closure section can be displaced to open the carton, thus altering the appearance of the carton. The subject invention further provides an unhinged slidable closure section which cannot wear out with repeated use. The display carton of the subject invention also provides a new and improved means for controlling the displacement of the closure section.

The present invention has been described in the above specification with reference to a specific embodiment, and such reference has been made for purely illustrative purposes and various modifications in the details included therein may be made without departing from the scope or spirit of the invention as will be obvious to those skilled in the art.

What is claimed is:

1. A tamperproof reclosable dispensing carton comprising an elongated tubular enclosure, including first and second side panels, and first and second edge panels, said enclosure being closed at opposed ends by a bottom panel, and an inner top panel, said first side panel having a first aperture disposed at an upper top corner thereof;

a dispensing panel including in turn, and hingedly connected, an outer top section, an apertured section, a middle section, and a slidable closure section, with said outer top section being hingedly connected to said second side panel and disposed in abutting relation with said inner top panel, and with said apertured section being disposed parallel and spaced from said first side panel, and having a second aperture which is in register with said first aperture, said apertured section further including a cover tab, rupturably connected thereto and disposed along the side edge of said apertured section opposed to said second aperture, and wherein the hinged connection between said middle section and said slidable closure section is rupturable, with both said middle section and closure section being disposed intermediate said first side panel and said apertured section, said middle section being adhesively connected to both the outer surface of said first side panel and the inner surface of said apertured section, and with said closure section initially covering said first aperture such that during the first dispensing operation upon the rupturing of the connections to the cover tab, said tab may be completely removed, thereby enabling the connections between said closure section and said middle section to be ruptured to permit slidable displacement of said closure section relative to said apertures thereby uncovering the first aperture in the first side panel and enabling the contents of the carton to be dispensed through the registered first and second apertures.

2. A dispensing carton as in claim 1 made of a single sheet of cardboard blank.

3. A dispensing carton as in claim 1 wherein a central portion of the hinge connection between said outer top section and said apertured section is spaced, defining a locking cut line, and where said slidable closure section includes a locking flange extending through and engaged along said locking cut line, such that the length and positioning of both the locking cut line and the locking flange determine the maximum displacement of said closure section.

4. A dispensing carton as in claim 1 wherein said first and second apertures are of generally circular configuration with a diameter larger than the diameter of a single item to be dispensed from within the carton.

5. A dispensing carton as in claim 1 wherein said closure section further includes an arcuate flange disposed beneath said cover tab to aid in the manual gripping of said slidable closure section.

6. A dispensing carton as in claim 1 wherein said cover tab has a generally semi-circular configuration.

7. A dispensing carton as in claim 1 wherein the sum of the widths of said middle section and said closure section equal the width of said apertured section.

8. A tamperproof reclosable dispensing carton made of a single sheet of cardboard blank, comprising an elongated tubular enclosure, including first and second side panels, and first and second edge panels, said enclosure being closed at opposed ends by a bottom panel, and an inner top panel, said first side panel having a first aperture disposed at an upper top corner thereof;

a dispensing panel including in turn and hingedly connected, an outer top section, an apertured section, a middle section, and a slidable closure section, with said outer top section being hingedly connected to said second side panel and disposed in abutting relation with said inner top panel, and with said apertured section being disposed parallel and spaced from said first side panel, and having a second aperture which is in register with said first aperture, and wherein said first and second apertures are of generally circular configuration with a diameter larger than the diameter of a single item to be dispensed from within the carton, said apertured section further including a cover tab, of generally semi-circular configuration, rupturably connected thereto and disposed along the side edge of said apertured section opposed to said second aperture, and wherein the hinged connection between said middle section and said slidable closure section is rupturable, with both said middle section and closure section being disposed intermediate said first side panel and said apertured section, with the sum of the widths of said middle section and said closure section being equal to the width of said apertured section, said middle section being adhesively connected to both the outer surface of said first side panel and the inner surface of said apertured section, and with said closure section further including an arcuate flange disposed beneath said cover tab to aid in the manual gripping of said slidable closure section, and wherein a central portion of the hinge connection between said outer top section and said apertured section is spaced, defining a locking cut line, and said slidable closure section includes a locking flange extending through and engaged along said locking cut line, such that the length and positioning of both the locking cut line and the locking flange determine the maximum displacement of said closure section, and with said closure section initially covering said first aperture such that during the first dispensing operation upon the rupturing of the connections to the cover tab, said tab may be completely removed, thereby enabling the connections between said closure section and said middle section to be ruptured, to permit slidable displacement of said closure section relative to said apertures thereby uncovering the first aperture in the first side panel and enabling the contents of the carton to be dispensed through the registered first and second apertures.

9. A blank made of paperboard and adapted to be folded into a tamperproof reclosable dispensing carton comprising:

a first edge panel;

a first side panel hingedly connected to said first edge panel, and including both an inner top panel and an outer bottom panel hingedly connected along the opposed edges thereof, said first side panel further including a first aperture, disposed in a corner of said first side panel and adjacent said inner top panel;

a second edge panel hingedly connected to said first side panel;

a second side panel hingedly connected to said second edge panel, and including an inner bottom panel hingedly connected along one edge thereof, and an inner edge panel, hingedly connected along an orthogonally opposed edge of said second side panel; and a dispensing panel, including in turn and hingedly connected, an outer top section, an apertured section, a middle section, and a slidable closure section, with said outer top section being hingedly connected to said second side panel, and with said apertured section including a second aperture being in register with said first aperture in the erected carton, said apertured section further including a cover tab, rupturably connected thereto and disposed on the side edge of said apertured section opposed to said second aperture, and wherein the hinged connection between said middle section and said slidable closure section is rupturable.

10. A blank as in claim 9 wherein the hinged connection between said outer top section and said apertured section includes a central spaced cut, offset towards said outer top section and defining a locking cut line, and with said closure section including a locking flange disposed along its outer edge and positioned to project through and be engaged in said locking cut line in the erected carton.

11. A blank as in claim 9 wherein said first and second apertures are generally circular in configuration having a diameter larger than the diameter of an item to be dispensed from the erected carton.

12. A blank as in claim 9 wherein said closure section further includes an arcuate flange disposed along the same edge of the dispensing panel as said cover tab.

13. A blank as in claim 9 wherein both said first and second edge panels further include end tabs disposed on opposed edges of each panel to aid in sealing the erected carton.

14. A blank as in claim 9 wherein said cover tab has a generally semi-circular configuration.

15. A blank as in claim 9 wherein the sum of the widths of said middle section and said closure section is equal to the width of said apertured section.

16. A blank made of paperboard and adapted to be folded into a tamperproof reclosable dispensing carton comprising:

a first edge panel;

a first side panel hingedly connected to said first edge panel, and including both an inner top panel and an outer bottom panel hingedly connected along the opposed edges thereof, said first side panel further including a first aperture, disposed in a corner of said first side panel and adjacent said inner top panel;

a second edge panel hingedly connected to said first side panel;

a second side panel hingedly connected to said second edge panel, and including an inner bottom panel hingedly connected along one edge thereof, and an inner edge panel, hingedly connected along an orthogonally opposed edge of said second side panel; and a dispensing panel, including in turn and hingedly connected, an outer top section, an apertured section, a middle section, and a slidable closure section, with said outer top section being hingedly connected to said second side panel, and with said apertured section including a second aperture, being in register with said first aperture in the erected carton, and with both first and second apertures being of generally circular configuration and having a diameter larger than the diameter of an item to be dispensed from the erected carton, said apertured section further including a cover tab, rupturably connected thereto and having a generally semicircular configuration, and being disposed on the side edge of said apertured section opposed to said second aperture, and with the hinged connection between said middle section and said slidable closure section being rupturable, and with said slidable closure section including an arcuate flange disposed along the same edge of the dispensing panel as said cover tab, and with the sum of the widths of said middle section and said closure section being equal to the width of said apertured section, and wherein the hinged connection between said outer top section and said apertured section includes a central spaced cut, offset towards said outer top section and defining a locking cut line, and with said closure section including a locking flange disposed along its outer edge and positioned to project through and be engaged in said locking cut line in the erected carton.

* * * * *